US006225965B1

(12) United States Patent
Gilger et al.

(10) Patent No.: US 6,225,965 B1
(45) Date of Patent: May 1, 2001

(54) COMPACT MESH STOWAGE FOR DEPLOYABLE REFLECTORS

(75) Inventors: Lloyd D. Gilger, Torrance; Donald L. Jones, Los Angeles, both of CA (US)

(73) Assignee: TRW Inc., Redondo Beach, CA (US)

( * ) Notice: Subject to any disclaimer, the term of this patent is extended or adjusted under 35 U.S.C. 154(b) by 0 days.

(21) Appl. No.: 09/336,657

(22) Filed: Jun. 18, 1999

(51) Int. Cl.[7] ..... H01Q 15/14
(52) U.S. Cl. ..... 343/915; 343/912
(58) Field of Search ..... 343/915, 912

(56) References Cited

U.S. PATENT DOCUMENTS

| | | | | |
|---|---|---|---|---|
| 4,030,102 | * | 6/1977 | Kaplan et al. | 343/915 |
| 4,475,323 | * | 10/1984 | Schwartberg et al. | 52/111 |
| 4,989,015 | * | 1/1991 | Chang | 343/915 |
| 5,680,145 | | 10/1997 | Thomson et al. | 343/915 |
| 5,864,324 | * | 1/1999 | Acker et al. | 343/915 |
| 6,028,570 | * | 2/2000 | Gilger et al. | 343/915 |

FOREIGN PATENT DOCUMENTS

| | | |
|---|---|---|
| 0290729 | 11/1988 | (EP) . |
| 0807991 | 11/1997 | (EP) . |
| 0959524 | 11/1999 | (EP) . |

* cited by examiner

*Primary Examiner*—Don Wong
*Assistant Examiner*—Trinh Vo Dinh
(74) *Attorney, Agent, or Firm*—Michael S. Yatsko; Ronald M. Goldman

(57) ABSTRACT

A perimeter truss's mesh material (3) and radially extending support catenaries (7 & 9) extending from a central hub (8) are, by rotation of the hub, rolled up together like a bolt of cloth, essentially in synchronism with the folding of the perimeter truss (5), to thereby form a small sized body that fits within the barrel-like configuration formed by the folded perimeter truss.

11 Claims, 7 Drawing Sheets

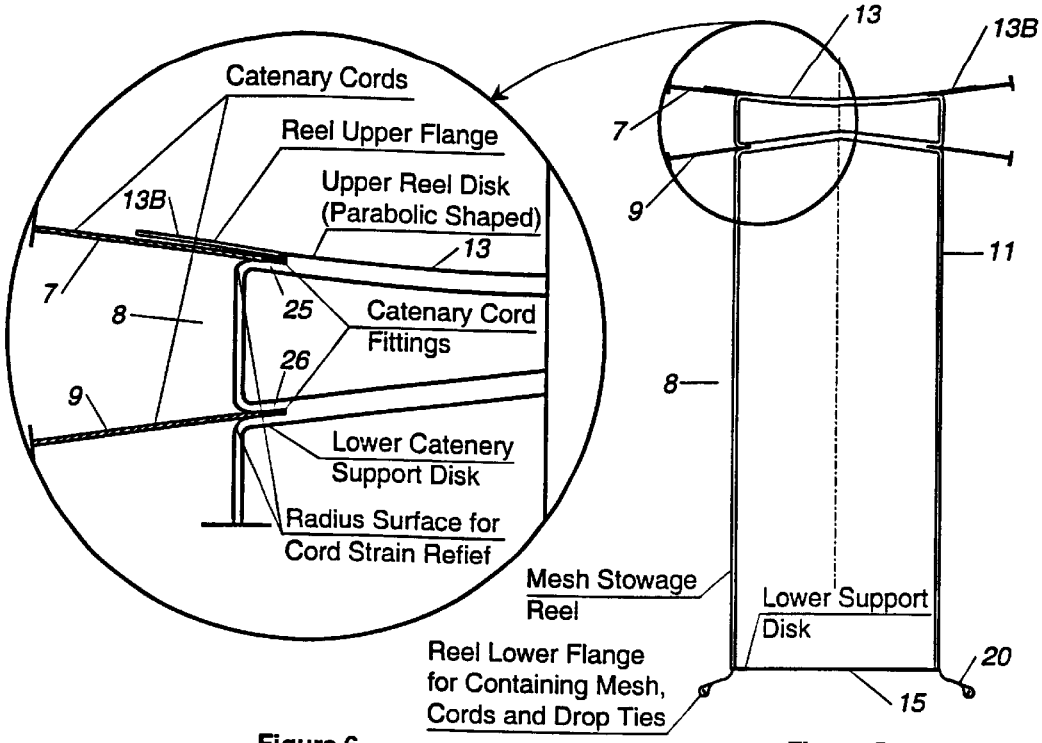
Figure 6
Figure 5
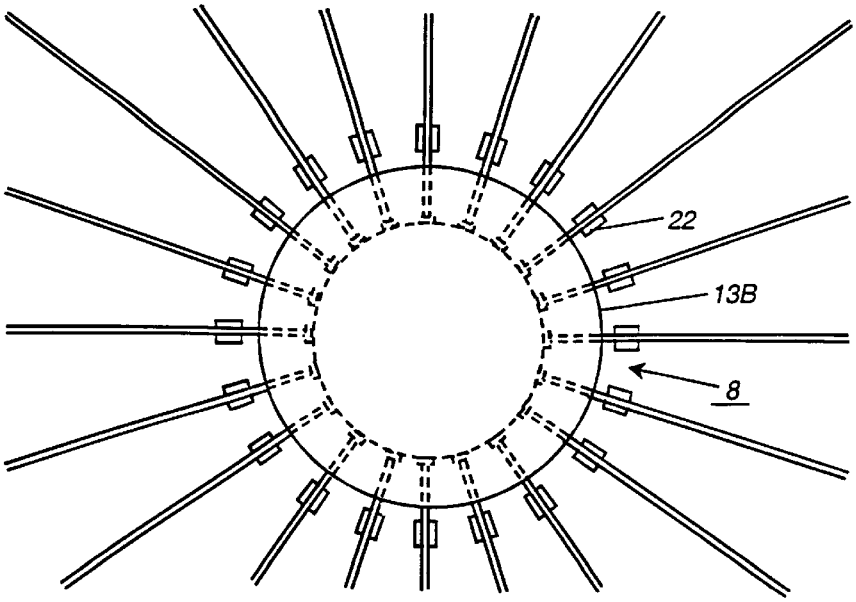
Figure 7

Perimeter Truss Reflector and Mesh with Stowage Reel in Deployed Condition

Partially Stowed Truss with Reel Raised Allowing Mesh and Cords to Spiral Wrap Down the Reel Wrapping Continues from Reel Base in a Controlled Spiral Wrap up Reel Until All Mesh is Stowed on Reel Fully Stowed Mesh and Truss Forming a Compact Barrel with Mesh Rolled on Stowage Reel Inside

COMPACT MESH STOWAGE FOR DEPLOYABLE REFLECTORS

FIELD OF THE INVENTION

This invention relates to deployable perimeter truss reflectors, and, more particularly, to a method and apparatus for folding and packing the reflective mesh material carried by the truss and to a new mesh and catenary support structure that enables such folding. Practiced in conjunction with folding of the perimeter truss reflector during final assembly, the reflective mesh is packed into the smaller sized bundles or rolls desired for stowage.

BACKGROUND

Deployable antennas find use on board spacecraft as an element of a space borne radiometer, radar or communication systems. At RF frequencies and higher the form of that antenna typically includes a deployable dish shaped reflector or, as variously termed, parabolic reflector whose surface reflects microwave energy. The general design and principles of RF operation of parabolic reflectors and the antennas formed therewith are fairly well understood and aptly described in the technical literature.

To minimize storage requirements on board the spacecraft, the antenna's reflector is constructed to be deployable. That is, the reflector folds into a much smaller sized configuration for stowage for the spacecraft's launch. Thereafter, when orbit in outer space is achieved, the reflector is unfolded outside the spacecraft to cover a much larger area. To accomplish such deployability the reflector structure incorporates various mechanical devices and structure that accomplishes folding and unfolding. It also includes a light weight pliant reflective mesh material, which serves as the reflective surface.

Typically the deployable reflector is folded but once, and that folding is accomplished at the time of the reflector's manufacture. Once deployed, the reflector remains deployed throughout its operational life in space; there is no need for it to re-fold. Not only does the reflector's structure incorporate foldable joint structures, but, to minimize launch weight, those structural elements are as strong and light in weight as existing technology permits.

A number of different types of deployable reflectors for space borne application have appeared in the past, the newest of which is the perimeter truss reflector, an advanced design that allows reflective surfaces to cover areas of much larger size and offers the greatest benefit. An example of an early perimeter truss reflector design is found in U.S. Pat. No. 5,680,145 granted Oct. 21, 1997 to Thomson et al, assigned to Astro Aerospace Corp. Another such reflector, more relevant to the present invention, is the more advanced design presented in the application of Messrs. Gilger & Parker Ser. No. 09/080,767 filed May 18, 1998 and now U.S. Pat. No. 6,028,570, granted Feb. 22, 2000, assigned to the present assignee, which is incorporated herein by reference, and sometimes referred to herein as the Gilger & Parker reflector or truss. The present invention is applied to a deployable perimeter truss antenna of the type described in the Gilger & Parker patent application and may be adapted to other deployable reflectors as well.

The principal elements of the deployable perimeter truss design include the reflective surface, the perimeter truss, and a catenary system; the latter being a series of tension lines attached to the truss that shapes and supports the reflective surface to the parabolic shape. As unfolded and deployed, the perimeter truss reflector appears as a large diameter short hollow cylinder, with the dish-shaped reflective surface, supported by the catenary system, covering one end of that cylindrical structure. The truss's cylindrical wall comprises a skeletal frame of tubular members in a closed loop, that in appearance, in many respects, is reminiscent of the frame of a steel skyscraper, but with the top end of the skyscraper's frame wrapped around into a circle and joined to its bottom end.

The reflective surface is formed of pliant reflective material. That material may comprise a pliant metal gauze, mesh, cloth-like material or a thin metallized membrane, or any other material as well. At the higher RF frequencies the mesh material is formed of very fine gold plated filaments joined in a fine mesh that resembles women's nylon stocking and is almost invisible to the eye. At the lower RF frequencies the mesh may be more coarse in nature and resemble chicken coop wire.

To mold and shape as well as to hold the reflective mesh in place on the truss, typically, the front and rear ends of the truss contains a geodesic backup structure as found in the Thompson patent or a catenary system, the series of tension lines, catenaries, that structurally define the parabolic surface in a skeletal or wire form. The catenaries are supported at the trusses peripheral end edges and extend across the end of the truss.

The catenary lines located on the trusses front end overlie and are aligned with like catenary lines supported on the trusses rear end. By tying or otherwise connecting various points along a single catenary to like points on the underlying catenary line with ties of different selected lengths, referred to as drop lines, each catenary may be shaped to approximate a portion of a parabolic curve. By judiciously shaping each catenary in the series to an appropriate portion of a parabolic curve, an entire parabolic surface is skeletally defined. That skeletal paraboloid surface serves as a wall, seat or bed, however characterized, on which the reflective surface is placed, somewhat like a bed sheet laid upon a bed, or, alternatively, as a tissue blown against a window screen.

As folded up for stowage, the reflector appears as an elongate cylindrical shape formed of a collection of structural elements closely packed together, often referred to as a "barrel". The reflective mesh material is packed inside that barrel.

The Gilger & Parker perimeter truss reflector, earlier referred to, is a new design. For a given diameter as deployed, that unique reflector folds to a more compact size than prior perimeter truss designs. As a consequence for a given application, reflectors of the Gilger & Parker design may fit within the available storage space on some rockets, when reflectors constructed in accordance with prior older designs could not. That advantage, for one, allows a mission to be accomplished without requiring a new larger rocket to first be designed and built.

The Gilger & Parker perimeter truss incorporates a series of deployable spars which, as deployed, extend outwardly from the front and rear ends of a truss that is formed of structural members. An outer end of each of the spars is connected to an associated tension line that forms a hoop about the respective end of the reflector. Those ends also attach to a respective catenary line, the latter line supported from the end of those spars. The deployable spars give the truss a greater expanse. Together with the hoop tension lines the deployable spar arrangement avoids any necessity for using stiff structural members for the interconnection, avoiding the greater weight inherent in structural members. For a given deployed diameter, the Gilger & Parker reflector is thus lower in weight than the prior designs. There are other advantages not here described for which the interested reader is referred to the cited Parker & Gilger patent application.

The foregoing structure, only briefly summarized, may be difficult for the lay person to visualize, at least initially. Some such readers might find it helpful to briefly refer to some of the partial illustrations of the Gilger and Parker perimeter truss reflector presented in the first two drawing figures and/or make reference to the cited patents or applications before proceeding further in this description.

Unfortunately, the smaller stowed size of the Gilger & Parker perimeter truss reflector has an inherent drawback. Space deployable parabolic mesh reflectors require very elaborate and complex mesh stowage systems. Generally the mesh material is susceptible to damage from tight fold lines; and the mesh could possibly snag or get caught on many structural pieces of the truss. To avoid those potential inherent problems, the stowage systems employed in the past generally fold the mesh inside the "barrel" formed by the truss's folding ribs. With the advent of the new deployable perimeter truss reflector presented in the cited application to Gilger and Parker, the available interior space for storing the mesh is considerably reduced.

The available stowage volume in the Gilger &Parker reflector appears marginal for existing mesh folding techniques. To successfully pack the mesh using existing techniques is time consuming, tedious and difficult and requires the time and attention of many assembly technicians. Unless a suitable mesh structure and folding procedure is available the great advantages resulting from use of that novel reflector design might not be realized.

Accordingly, an object of the invention is to provide a more efficient method of packing the truss reflector's mesh and catenary system for stowage.

Another more specific object of the invention is to provide a method to pack the reflective mesh of a Gilger and Parker deployable spar type perimeter truss reflector.

A further object of the invention is to pack the reflective mesh and catenary lines of a foldable perimeter truss reflector into a compact small sized package that conveniently fits within the truss's barrel configuration as stowed.

An additional object of the invention is to provide a modification to the catenary support system that accommodates and enables more efficient mesh packing.

And a still additional object of the invention is to provide a new tool with which the new method of packing the truss reflector's mesh may be readily practiced.

SUMMARY OF THE INVENTION

In accordance with the foregoing objects and advantages, a deployable perimeter truss reflector contains catenary lines that extend radially outward from a central hub and extend to the surrounding perimeter truss with the reflective mesh supported by those catenaries. The central hub is an elongate cylindrical body which extends below the catenary lines leaving exposed a significant portion of the hub's cylindrical surface, whereby the hub also serves as a spool or reel. For stowage, the reflective mesh and catenary lines are concurrently rolled up onto the hub as the perimeter truss is folded. Held at the center, the mesh material is spirally rolled up like a bolt of cloth; rolled up essentially in synchronism with the folding of the perimeter truss.

The foregoing procedure is simple to perform and efficiently folds the mesh into the desired small size package. It minimizes the risk of snagging catenary lines in the folding operation. Importantly, it makes a time consuming and tedious operation into one that can be carried out in relatively short order. The mesh is never loose or draped all over the truss structure as it is in other perimeter structures of conventional design, another decided advantage.

A further advantage occurs when the perimeter truss reflector is subsequently deployed. The mesh roll is automatically released from its captured position within the disappearing barrel structure. It simply unrolls as the hoop line, a tension line, on the truss expands outwardly to draw out the mesh material from the roll. Ultimately all the material is withdrawn so that the roll is spent and disappears. The mesh is donut shaped in place at the front end of the perimeter truss.

The mesh is always held taut between the unfolding roll and the deploying hoop. In the near zero frictional condition of outer space, the mesh roll is prevented from over running the deployment rate of the perimeter truss due to the "Velcro" effect between layers of mesh, the clinging of the layers of material to itself. The mesh releases itself from the roll only as it is gently tugged by the expanding hoop line.

The foregoing and additional objects and advantages of the invention together with the structure characteristic thereof, which was only briefly summarized in the foregoing passages, becomes more apparent to those skilled in the art upon reading the detailed description of a preferred embodiment, which follows in this specification, taken together with the illustration thereof presented in the accompanying drawings.

BRIEF DESCRIPTION OF THE DRAWINGS

In the drawings:

FIG. 5 is a section view of the hub component of FIGS. 2 and 4;

FIG. 6 is an enlarged section view of a portion of the hub of FIG. 5 taken along the lines 6—6;

FIG. 7 shows the hub and catenary lines of FIG. 4 in top view;

DETAILED DESCRIPTION OF THE PREFERRED EMBODIMENT

Figure 1:
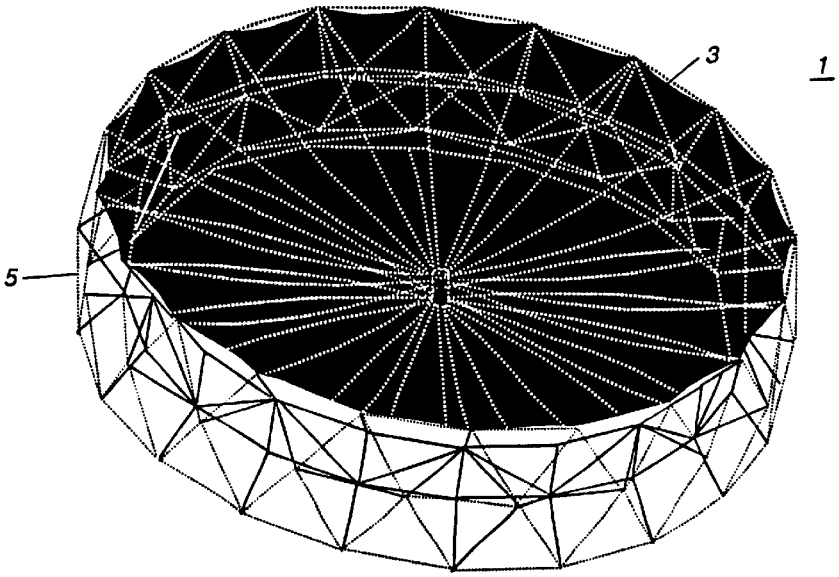
FIG. 1 is a Gilger & Parker type deployable perimeter truss reflector incorporating the improvement illustrated in the fully deployed condition with the shaded area representing the gossamer conductive mesh.

The invention is presented within the environment and structure of a Gilger & Parker deployable perimeter truss reflector, earlier briefly introduced, that contains deployable spars; and to help visualize that truss reflector more readily, FIG. 1 illustrates a foldable or, as variously termed, deployable perimeter truss reflector 1 of that type. Illustrated in its deployed condition ready for use as a principle antenna component, reflector 1 includes a parabolically curved reflective surface 3, represented by the shading, splayed taut and supported over the front end of a perimeter truss 5.

In practice, the reflective surface 3 comprises a reflective mesh material that is pliant and, in optical characteristic, is translucent permitting the truss elements to be partially visible but somewhat obscured. Reflective mesh material 3 is supported on truss 5 by the catenary system 6, better illustrated in the next figure, later herein described in greater detail.

Figure 2:
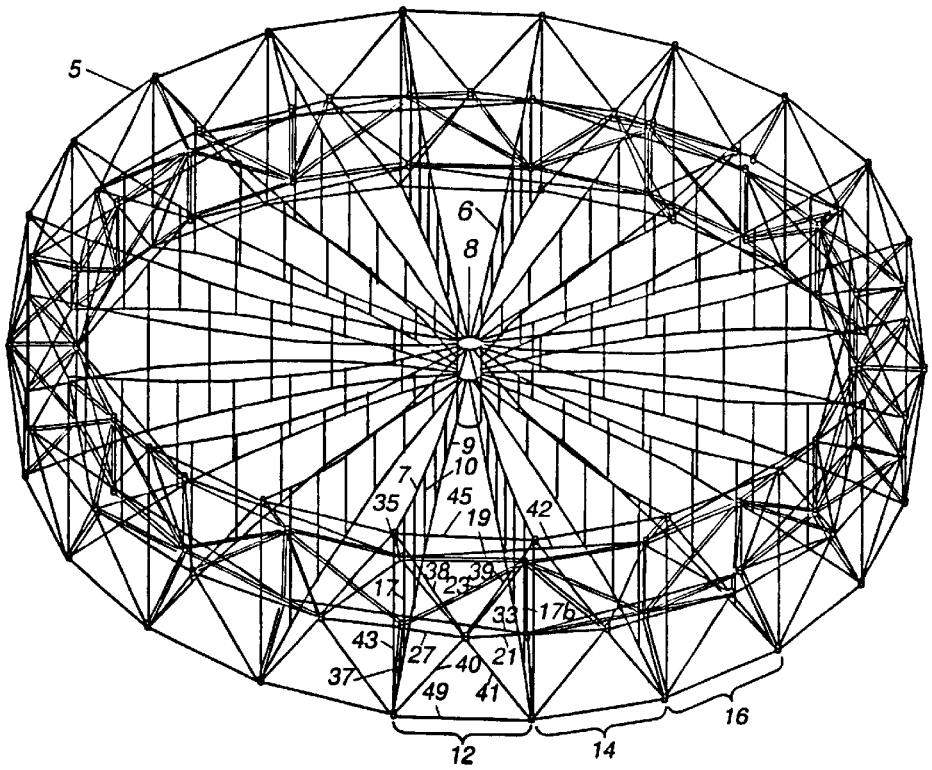
FIG. 2 is a slightly enlarged view of a Gilger & Parker perimeter truss of FIG. 1 absent the reflective mesh, allowing view of the structural truss member, tension lines and the catenary system as modified by the present invention.

Omitting reflective mesh 3, FIG. 2 more clearly shows the perimeter truss 5 and the supported catenary system 6 that in turn supports reflective mesh surface 3. Truss framework 5 appears as a short hollow cylinder whose cylindrical wall is a skeletal framework of various structural members, frame and brace members, arranged in a regular pattern that repeats about the periphery of the short cylinder. The front and rear ends of the truss is defined by a single edge. Each subdivision of the truss is referred to as a bay, such as bays 12, 14, and 16. Twenty such bays are included in the perimeter truss illustrated.

Structural members 17, 19, 21, and 17*b*, partially defining bay 12, form a four sided polygonal figure, a rectangle, a pattern that is repeated through out the truss, defining a basic framework that extends in a curved or circular loop. Another structural member 23 extends diagonally between opposed corners of that rectangle, and forms a base of a triangle with two additional members, triangle members 27 and 29 completing the triangle. It is seen that the foregoing structure in bay 12, is the mirror image of the corresponding structure in the next adjacent bay 14, a pattern that continues about truss 5.

Guy lines 38, 39, 40 and 41 anchor the juncture of triangle members 27 and 29 to corners of the rectangular frame structure. Another tension line 33 extends between that juncture and like junctures in all the other bays, defining a middle hoop line to the truss. Upper and lower deployable spars 35 and 37, located on the left side of bay 12, extend outwardly and away from that basic framework. The ends of the upper spars are joined to a hoop line 45, and, together therewith, defines a closed loop of even greater diameter than formed by the polygonal structure. A like arrangement is provided for the lower deployable spars, such as spar 37, and its associated lower hoop line 49. The ends of the spars 35 and connecting line 45 define the front edge to the perimeter truss and the ends of spars 37 and connecting hoop line 49, define the truss's rear end.

Another tension line or guy line 43 extends between the ends of the upper and lower deployable spars in each bay. And another guy line 42 extends from the upper left corner of bay 12, at the end of vertical structural member 17, to the corresponding location on the upper right corner of the next adjacent bay 14. Guy lines corresponding to line 42 are included in the other bays as well to strengthen the truss structure. As shown, like tension lines to line 42 are also formed on the rear side of the polygonal configuration.

Catenary system 6 is formed of support lines, called caternaries, 7 and 9, only two of which lines are numbered, located on the front and rear ends of the truss. The catenaries are inextensible tension members, lines, that extend across the front and rear ends of the truss. The catenaries extend from a central location or hub 8 and radially extend outward to the ends of an associated deployable spar located at peripheral locations on the truss's front end. The front catenary 7 serves as a holding device or seat for the reflective mesh 3. The rear catenary 9 works in conjunction with the front catenary to provide an appropriate curved profile for the reflective surface.

Figure 3:
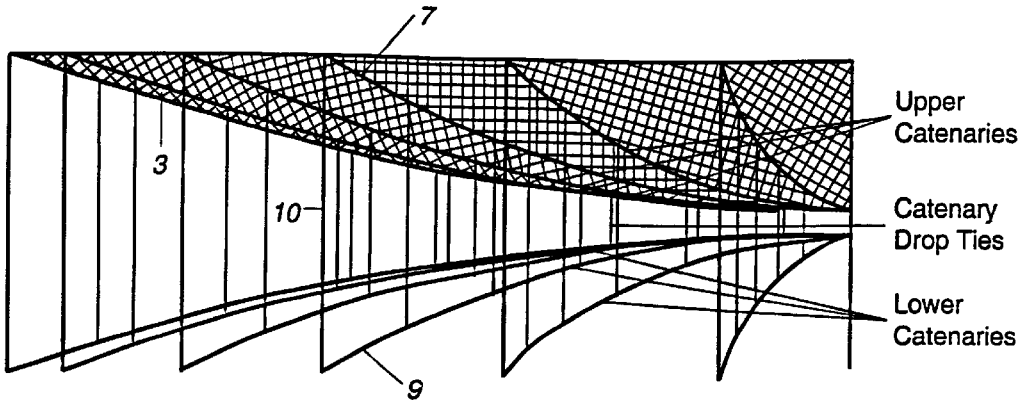
FIG. 3 is a partial perspective of a portion of the reflector's mesh and catenary system in the fully deployed position.

Each catenary, 7 and 9, in the system is shaped into a curve that approximates the parabolic surface of the reflective dish by drop ties 10, a series of tension lines of selected lengths, only one of which is labeled. A partial illustration of the catenaries and mesh is illustrated in FIG. 3 in a perspective view. The greater the number and the closer the spacing between drop ties 10, the more closely the curve formed by catenary lines 7 and 9 approximates a true parabola, and, thus, the higher the RF frequency that can be reflected by the reflective surface without significant signal loss.

Returning to FIG. 2, all of the catenary lines 7 and 9 radiate radially outward from the center of the truss to its peripheral edge and essentially form a pair of suspension systems at the trusses front and rear ends. As illustrated, the upper catenaries, including catenary line 7, only one of which is numbered, extend radially outward from centrally located hub 8 to the outer end of an upper deployable spar, such as spar 35. The lower catenaries, which are radially aligned with the upper catenaries, including the lower catenary 9 associated with catenary 7, also extend from the hub to the outer end of an associated lower deployable spar, such as the end of spar 37 to which lower catenary 9 connects.

Reflective mesh 3 is mounted beneath the front catenary lines 7. To mount the mesh in the foregoing way, during truss assembly the mesh is spread out under the front catenaries 7. Then drop ties 10 are threaded through the reflective mesh, prior to attachment to the opposite catenaries 9. The backside of the mesh naturally drapes and is pulled against the backside of front catenary lines 7, and is captured in place by the drop ties. The mesh is thus shaped by the front catenary into the parabolic shape. When deployed in outer space, the mesh presses against the front catenary lines 7 like a tissue blown by the solar wind.

Hub 8, only broadly visible in the figure, is seen as a generally cylindrical shaped member. The lines of both the upper and lower catenaries are attached to the hub proximate the upper end of the cylindrical member, leaving a substantial portion of the hub's length dangling below the lower catenary lines for purposes later herein described. Although the catenaries in the reflector described in the cited Gilger & Parker application employs a central hub as well, the foregoing hub differs in structure from that in the Gilger & Parker application and is an improvement to the catenary and mesh structure characteristic of the present invention.

Figure 4:
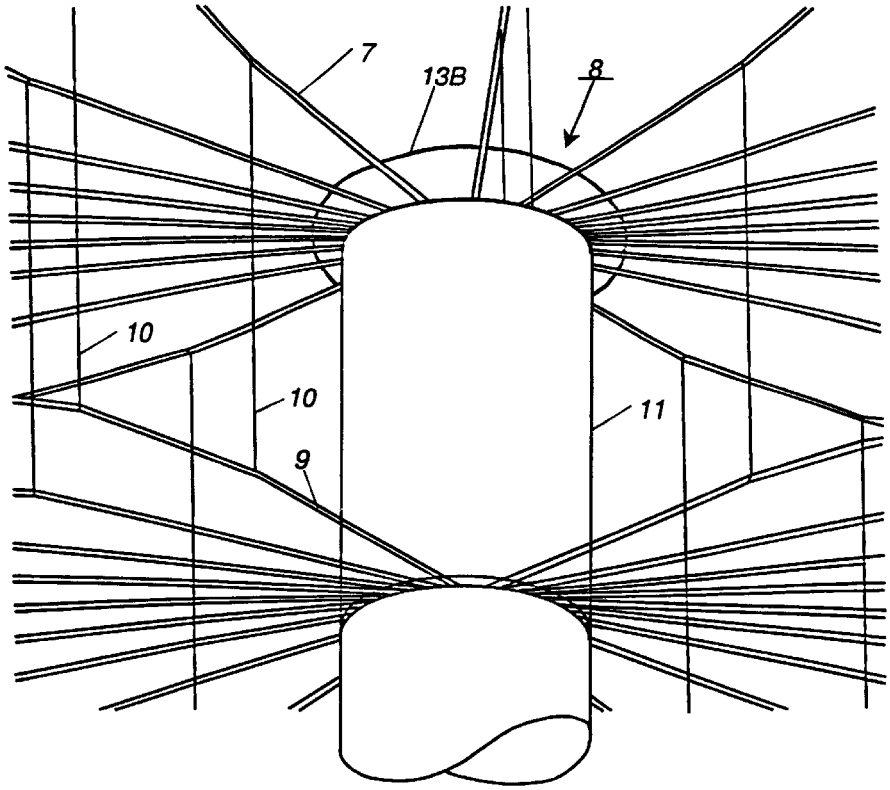
FIG. 4 is a close up perspective of the central region of the catenary system of the truss of FIG. 2 drawn in an enlarged scale to illustrate the hub component and catenary line connections thereto in greater detail.

FIG. 4 to which reference is made provides a close-up perspective view of a portion of hub 8 as viewed from a position on the underside of catenary lines 7. The hub is characterized by a generally cylindrical body 11. A radially outwardly extending upwardly curved flange 13 caps the upper end of the cylinder and overlies the ends of the upper catenary lines 7, which are evenly distributed about the cylindrical periphery and affixed thereto. A like flange is located at the hub's bottom end, not visible in the figure, but illustrated in FIG. 5, next considered. The lower catenary lines 9 are also evenly distributed about the cylindrical surface and attach to the cylindrical body a short distance below the upper catenary lines.

As illustrated in section in FIG. 5, hub 8 is a generally hollow cylindrical member whose upper and lower ends are closed by support disks 13 and 15, respectively. The upper surface of upper support disk 13 contains flange 13B integrally formed in the support disk. Both the support disk and flange are formed of a reflective material and are preferably concavely parabolically shaped to conform to the desired reflector shape at the center location of the reflector. The lower flange 20 is formed integral with the cylindrical hub body. It extends radially outwardly and downwardly at a slight angle from the end of the cylindrical body portion and is smoothly shaped. Its' edge is rolled over so as to preclude any edges as might possibly snag the mesh. With the foregoing geometry the hub resembles a reel or spool. As becomes apparent from the following description of operation, hub 8 also serves as a spool or reel for the mesh and catenaries.

The axial length of the formed reel is approximately the same length as the "barrel", earlier referred to, formed by the collapsed truss when in its stowed condition. As will be appreciated later in this description, the collapsed truss 5 folds into a barrel configuration on the outside surface of the foregoing reel, enveloping therein the reeled up reflective mesh.

The connection of the catenaries to the hub is illustrated in a greater scale in the partial section view of FIG. 6, which is a section taken along the lines 6—6 in FIG. 5. The hub contains a peripheral groove 25 underlying flange 13. The ends of each catenary line 7 is fastened into that groove by appropriate fittings. A like peripheral groove 26 extends about the axis of the cylindrical wall a short distance below groove 25, and the ends of the lower catenary lines 9 are fitted into that groove.

The partial view of FIG. 7 illustrates the foregoing hub 8 disk 13, flange 13B and upper catenary lines 7 as viewed from the top end. Although adhesive fittings may be used to connect the catenary lines 7 to hub 8, the preferred attachment is better accomplished with a turnbuckle arrangement, such as illustrated by turnbuckles 22, only one of which is labeled.

In that turnbuckle fastening arrangement, a cap or other cylindrical member, not illustrated, whose outer surface is threaded with a left handed thread is secured to the end of a catenary line. The cylindrical passage in the side of hub 8 associated with that catenary line is threaded with a right handed thread. Then a turn buckle 22, which contains a left and right handed threaded projections on the respective rear and front end engages the respective mating threaded portions of the catenary line and hub passage. The turnbuckle is turned to secure the connection and place the associated catenary line in tension. The foregoing is recognized as a conventional connecting device. Like turnbuckles are included with the lower catenary lines 9.

It should be appreciated that the foregoing core structure is reminiscent of a spool for cotton thread or a fishing reel. That component serves a similar spooling function as becomes apparent from the succeeding description of operation in which the mesh is reeled-up.

Figure 8:
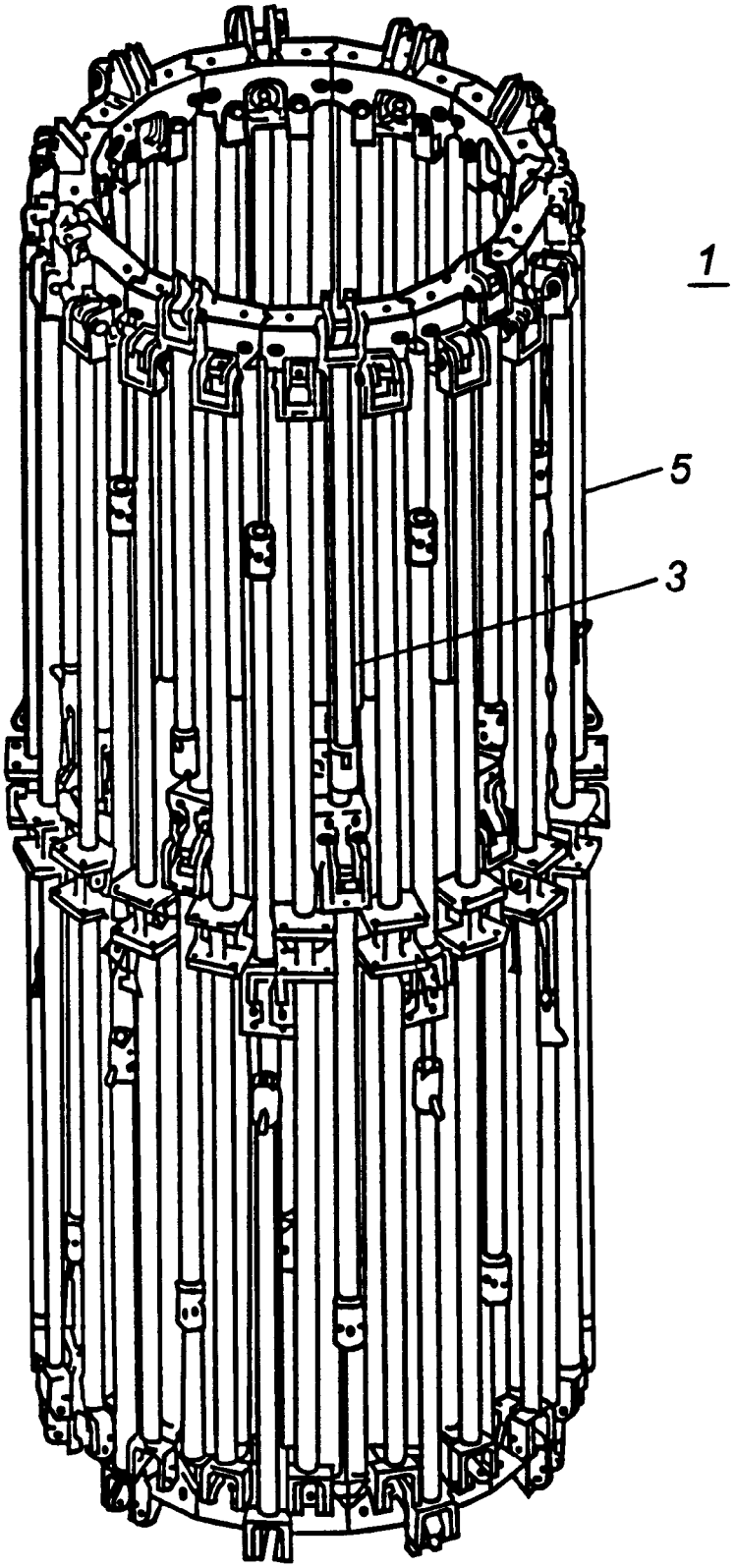
FIG. 8 is a perspective of the perimeter truss of FIG. 2 in the stowed condition to form a barrel configuration.

As described in the Gilger & Parker application, the foregoing truss reflector, as it appears at the time of completion of manufacture, folds from the deployed condition as illustrated into a much smaller diameter elongated barrel configuration in which stowed. The trusses stowed configuration is partially illustrated in FIG. 8, with the catenary lines and mesh omitted for clarity. It is noted that FIG. 8 is drawn to a substantially larger scale than used to illustrate the truss as deployed in FIGS. 1 and 2 in order to permit individual structural elements to be visibly distinguishable. As illustrated, truss 5 collapses or folds up neatly and form a cylindrical structure, referred to as a barrel, that is substantially smaller in diameter than when deployed. As shown the center of that barrel is hollow and provides the space in which to pack the reflective mesh and catenary system, as latter herein described.

Figure 9:
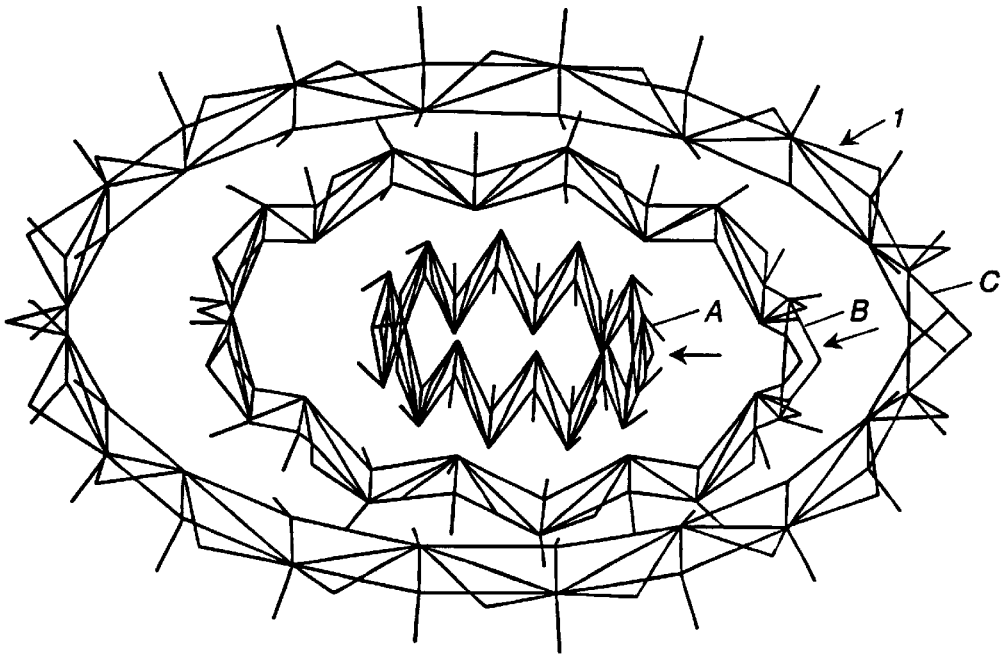
FIG. 9 symbolically illustrates the changes in configuration of the perimeter truss in several stages of folding between the full radius as deployed and a near stowed condition, omitting the mesh and catenary lines for clarity.

As pictorially illustrated in FIG. 9, the foregoing Gilger & Parker perimeter truss is manufactured and assembled in the deployed configuration, symbolically illustrated in the figure by the greatest diameter truss, labeled "C". For clarity of illustration of that radial contraction, the mesh and the catenary system are omitted in the figure. In being carefully folded down to the stowed condition by technical personnel, the radius of the truss contracts as the structural elements fold, as represented by the smaller diameter figure, labeled "B". As the trusses elements continue to be folded, the structure radially contracts further, as represented at "A", while the overall height of the configuration increases slightly, as the components approach the elongate barrel configuration that was depicted in FIG. 8.

It is appreciated that the present specification does not completely detail the specific structural details of the truss, which permits the truss to be folded or those describing the associated deployment mechanism to unfold the truss from the small barrel configuration for deployment, since they do not form a part of the present invention and are necessary to an understanding thereof. Those details of construction are described at great length in the cited Gilger & Parker application, Ser. No. 09/080,767 filed May 18, 1998, copending herewith and now U.S. Pat. No. 6,028,570, to which the interested reader may make reference. Alternatively, to the extent it is believed necessary to include those details in the present specification, the description and illustrations of that novel deployable perimeter truss reflector presented in said Gilger & Parker application are incorporated herein by reference.

It should be appreciated that as the radius of the cylindrical truss configuration decreases, the reflective mesh and catenary lines, held taut when the truss is deployed, would naturally slacken and drape. And with the number of moving elements involved, there appears ample opportunity for a catenary line or some portion of the mesh material to snag on a truss member. Thus in the prior system as many as four technicians must work together and ensure that the catenary lines and mesh accurately fold. It should be appreciated that the foregoing is a time consuming, difficult, and tedious task. The new structure and method handles the mesh and the catenary lines in a more expeditious manner that avoids any possible snagging.

Figure 10:
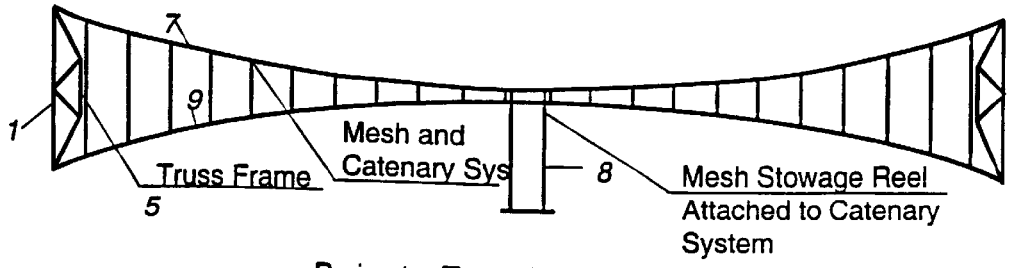
FIG. 10 pictorially illustrates the truss reflector as fully deployed in a section view intended to aid in understanding the winding operation.

Reference is made to the pictorial section view of the truss presented in FIG. 10, which shows the truss, mesh and catenary system as fully deployed. In this position the mesh and catenary lines are taut and in the desired shape as partially illustrated earlier in the perspective view of FIG. 3. Returning to FIG. 10, hub 8 is seated upon a movable table, not illustrated in this figure. That table is designed to rotate the hub about its axis as well as to raise and lower that hub vertically.

In a succeeding step, the outer periphery of truss 5 is pushed or pulled radially inwardly by the technicians to commence folding. Since the present invention concerns only the catenary system and mesh, the manner in which the truss folding is accomplished by the technicians is not necessary to an understanding of the invention and need not be described. However, the interested reader may make reference to the cited Gilger and Parker patent application for a description of one such method.

Figure 11:
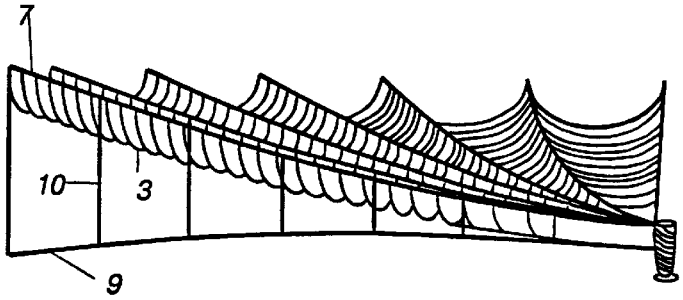
FIG. 11 shows a partial perspective of the catenaries and reflective mesh at a stage when fold up of the truss has commenced.

The initial inward collapse of the supporting truss 5 causes the mesh 3 to drape. This is partially illustrated in the perspective view of FIG. 11, to which reference is made. Instead of being taut, the catenary lines 7 drape slightly and the mesh 3 drapes between each pair of those catenary lines.

Figure 12:
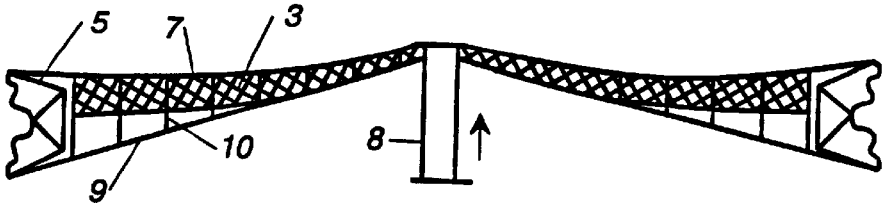
FIG. 12 pictorially illustrates the truss reflector of FIG. 10 at a succeeding stage in fold-up and commencement of the procedure to wrap the mesh and catenary system onto the hub.
Figure 13:
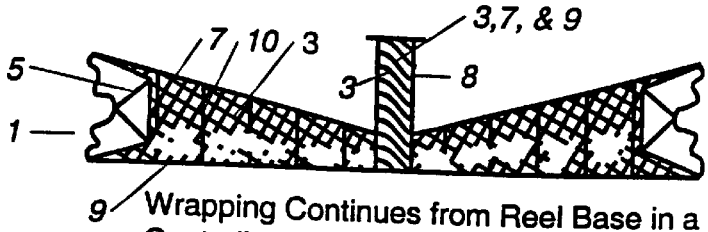
FIG. 13 illustrates a succeeding stage in the mesh wrapping procedure.

Reference is made to FIG. 12, which pictorially illustrates the next step in the mesh folding operation. As the catenary lines 7 and 9 start to drape as illustrated, the support table raises the reel in elevation so that the bottom end of the hub is about even with the bottom end of truss 5 and then slowly rotates reel 8 slightly. Now by rotating hub 8 in synchronism with the folding of perimeter truss 5, the mesh begins to roll onto the cylindrical wall of hub 8, and the drop ties 10, that joint upper and lower catenary lines 7 and 9 remain straight and vertical. As is apparent from the figure, the catenary system 6 and mesh 3 wraps or winds onto the hub in a spiral that progresses downwardly along the hub's axis, such as illustrated in FIG. 13.

If the formed spiral reaches the lower end of the reel, and is not completely wound up onto the reel, the table continues to turn the reel and wind up the remainder, essentially bunching up the mesh at the reel's lower end.

Alternatively, if it is desired to have the mesh evened out on the reel, the table height control may be made to reverse direction when the mesh reaches the reel's lower end, lowering the reel axially as the table continues to turn. In such event, the mesh winds back up the reel. Ideally, the wind up should be such that at the conclusion of winding the truss's structurally elements are centered at the axial midpoint of the reel. The foregoing relationship is attained by judicious selection of and relationship between the diameter of the reel and the radius of the perimeter truss.

Figure 14:
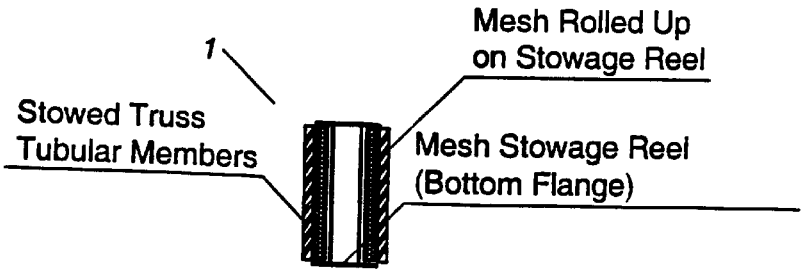
FIG. 14 pictorially illustrates the perimeter truss reflector in the stowed condition at the completion of the procedure of folding up the truss and the concurrent wrap up of the mesh and catenary system.
Figure 15A:
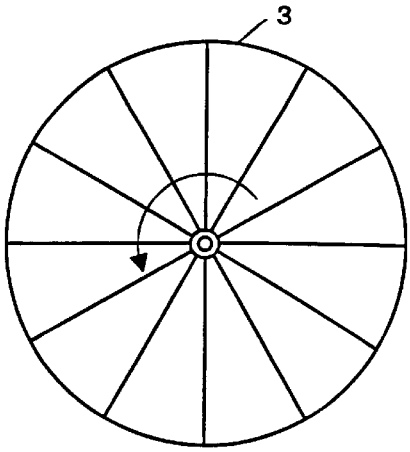
FIGS. 15A through 15G pictorially illustrate the appearance of the mesh in various stages being spirally wrapped onto the hub.
Figure 15B:
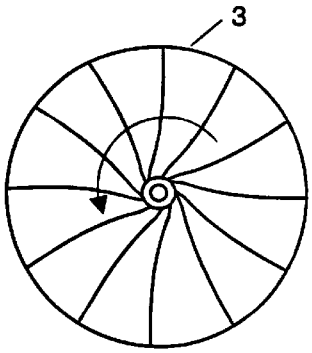
Figure 15C:
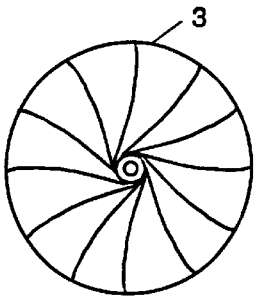
Figure 15D:
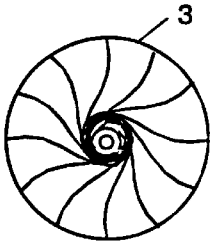
Figure 15E:
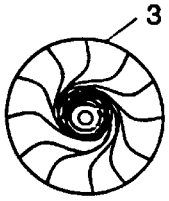
Figure 15F:
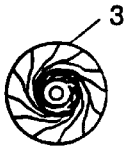
Figure 15G:
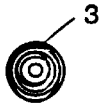

Ideally the table includes a clutch or other mechanism that maintains a predetermined tension on the line, and decouples the drive from the reel to prevent rotation should the tension exceed that tension level. Such a control arrangement permits the winding to proceed in synchronism with the folding of the truss. As the truss collapses further, the tension on the catenary lines falls. With that lowering of tension, the motor couples to the reel and turns it further, re-tensioning the catenary line. That process continues until the truss is completely folded and the mesh fully wound up on the reel. The foregoing winding control is akin to the take-up reel used in fly cast fishing that automatically maintains the fishing line taut even though the hooked fish moves toward the fisherman to slacken the fishing line. Once both the fold down of truss 5 and the roll up of the catenary systems and mesh 3 is completed, the elements fit together compactly as pictorially illustrated in FIG. 14. As viewed from the top of the reflector, the spiral wrapping of mesh 3 onto hub 8 is pictorially illustrated by FIGS. 15A through 15G.

Figure 16:
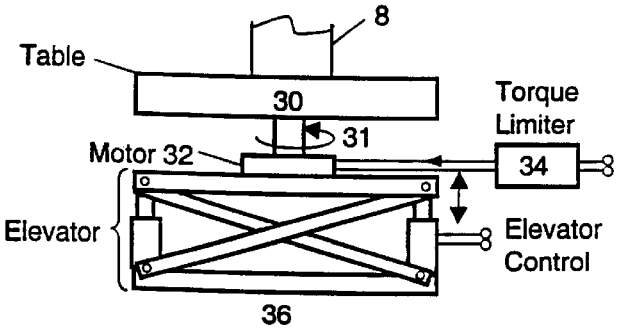
FIG. 16 illustrates a table-like fixture that assists in spirally wrapping the mesh.

An electrically powered positioning and motor apparatus for performing the foregoing windup is pictorially illustrated in FIG. 16. The apparatus includes a disk shaped table 30 on which to seat the bottom end of hub 8, partially illustrated. The table is supported on a rotatable shaft 31 that is driven by an electric motor 32. Suitably a torque limit controller 34 is included in the driving mechanism for the motor to prevent the motor from driving the shaft if the torque exceeds a level preset by the technician. In turn motor 31 is supported on an elevator or, as variously termed, vertical positioning mechanism 36. The elevator's height is electrically controlled by a conventional controller, not illustrated.

As a first step in the wrapping process, vertical positioning mechanism 36 is first operated to raise the vertical position of the table 30 and, hence, hub 8, a prescribed amount, as earlier herein described. Then motor 34 is operated to turn the shaft at a very slow rotational rate. Suitably the friction between the table's upper surface is sufficient to couple to and rotate hub 8, since the resistance of the gauze-like mesh and catenaries is very low so little torque is required to turn the shaft 31. As the perimeter truss is being contracted, the shaft is turned in a kind of synchronism to begin wrapping the mesh about hub 8, as pictorially illustrated in FIGS. 15A and 15B. In order that the mesh not collect entirely about one axial position along the hub, the elevator gradually lowers, changing the axial position along the hub at which additional turns of mesh are being wound. This is similar in principal to winding a thread onto a bobbin. Thus not only is the mesh spirally wrapped, but it is also distributed along the axis of the hub while the spiral wrapping takes place. In that way the wrapped material is almost uniformly distributed so as to pack into a cylindrical configuration whose diameter is the smallest possible diameter.

Suitably, the technician may personally control vertical positioning mechanism 36 and command its descent following the commencement of rotation of motor 34, thereby synchronizing the two concurrent movements. In more sophisticated fixtures, such synchronization may be accomplished automatically with suitable electronic circuit apparatus.

It is believed that the foregoing description of the preferred embodiments of the invention is sufficient in detail to enable one skilled in the art to make and use the invention. However, it is expressly understood that the detail of the elements presented for the foregoing purpose is not intended to limit the scope of the invention, in as much as equivalents to those elements and other modifications thereof, all of which come within the scope of the invention, will become apparent to those skilled in the art upon reading this specification. Thus the invention is to be broadly construed within the full scope of the appended claims.

What is claimed is:

1. In a deployable perimeter truss reflector having a deployed condition and a stowed condition and containing a collapsible perimeter truss, a reflective surface of pliable reflective material and a catenary system for supporting said reflective surface on said perimeter truss, in which said catenary system includes:

a hub;

a first plurality of catenary lines connected to and radially extending from said hub to said perimeter truss, said catenary lines of said first plurality being angularly spaced from one another about said hub;

a second plurality of catenary lines connected to and radially extending from said hub to said perimeter truss, said catenary lines of said second plurality being angularly spaced from one another about said hub;

said second plurality of catenary lines being positioned underlying said first plurality of catenary lines;

and each of said catenary lines in said second plurality of catenary lines being angularly aligned with a respective catenary line of said first plurality of catenary lines, the improvement wherein said hub comprises:

a cylindrical surface for wrapping up spirally said first plurality of catenary lines, said second plurality of catenary lines and said pliable reflective material responsive to placing said perimeter truss reflector in the stowed condition.

2. The invention as defined in claim 1, wherein said hub further comprises:

a first radially outwardly directed flange at a first end of said cylindrical surface;

a second radially outwardly directed flange at an opposed end of said cylindrical surface, wherein said flanges and said cylindrical surface define a reel.

3. The invention as defined in claim 2 wherein said cylindrical surface is of a predetermined axial length; wherein said first plurality of catenary lines connects to said cylindrical surface at a position therealong underlying said first radially outwardly directed flange; and wherein said second plurality of catenary lines connects to said cylindrical surface at a position therealong underlying and adjacent to said first plurality of catenary lines to leave a major portion of said predetermined axial length of said cylindrical surface exposed.

4. The invention as defined in claim 3, wherein said collapsible truss, when collapsed, comprises a barrel configuration having a predetermined height; and wherein said predetermined axial length of said cylindrical surface is the same as said predetermined height of said barrel configuration.

5. The invention as defined in claim 4, wherein said first outwardly radially directed flange comprises a section of a paraboloid.

6. Apparatus for assisting in placing a deployable perimeter truss reflector in a stowed condition, said reflector including a pliant reflective mesh that defines a reflective surface, a deployable perimeter truss and a catenary system for supporting said pliant reflective mesh, said catenary system including a plurality of catenary lines radially outwardly extending from a central hub, and said deployable perimeter truss being foldable into a barrel-like configuration when stowed, comprising:

a table for receiving the bottom end of said central hub;

first positioning means for elevating said table to elevate said hub a predetermined amount above said hub's deployed position and then gradually lowering said table; and second means for rotating said table to rotate said hub when said hub is elevated said predetermined amount to spirally wind said pliant reflective material and said catenary lines onto said hub.

7. The invention as defined in claim 6, wherein said first positioning means de-elevates said table to lower said hub to said hub's deployed position, and, further comprising: means synchronizing rotation of said second means with de-elevation of said table, whereby said pliant reflective material and said catenary lines are spirally wound abet and along a predetermined axial extent of said hub.

8. The method of packing a pliant reflective mesh of a deployable perimeter truss reflector, said pliant reflective mesh having a center and defining a reflective surface, said deployable perimeter truss reflector including a deployable perimeter truss and a catenary system for supporting said pliant reflective mesh, said deployable perimeter truss having a central axis, front and rear ends and a predetermined axial length between said front and rear ends, and said catenary system including catenary lines for supporting said pliant reflective mesh with said center of said pliant reflective mesh positioned on said central axis of said perimeter truss, said catenary lines being evenly divided between a first and second plurality of catenary lines, said first plurality of catenary lines extending from a first position along said central axis of said perimeter truss to said truss, and said second plurality of catenary lines extending from a second position along said central axis of said perimeter truss to said truss, and said first plurality of catenary lines being angularly aligned with said second plurality of catenary lines about said central axis of said truss, comprising the step of:

rotating said center of said pliant reflective mesh while said perimeter truss is simultaneously being contracted in shape from a wide diameter deployed configuration to a smaller diameter barrel-like configuration to roll up said pliant reflective mesh into a small diameter configuration fitting within said deployable perimeter truss when said deployable perimeter truss attains said barrel-like configuration.

9. The method of packing a pliant reflective mesh that defines the reflective surface of a deployable perimeter truss reflector, said deployable perimeter truss reflector including a deployable perimeter truss having front and rear ends and a predetermined axial length between said front and rear ends and a catenary system for supporting and shaping said pliant reflective mesh, said catenary system including a plurality of catenary lines radially outwardly extending from a central core, said plurality of catenary lines being evenly divided between a first and second plurality of catenary lines, said first plurality of catenary lines having an end attached to said central core at a first position along the axis of said central core, and said second plurality of catenary lines having an end attached to said central core at a second position along the axis of said central core, and said first plurality of catenary lines being angularly aligned with said second plurality of catenary lines about said central core and said deployable perimeter truss being foldable into a barrel-like configuration when stowed, comprising the step of:

rotating said central core while said deployable perimeter truss is simultaneously being contracted in shape for stowage from a wide diameter deployed configuration to a smaller diameter barrel-like configuration to roll up said catenary lines and said pliant reflective mesh into a small configuration on said central core that fits inside said deployable perimeter truss when said deployable perimeter truss attains said barrel-like configuration.

10. The method as defined in claim 9, wherein said central core includes a cylindrical outer wall, and upper and lower flanges extending outwardly from said cylindrical wall to define a reel, said first plurality of catenary lines being evenly distributed about the periphery of said cylindrical wall and having an end attached thereto underlying said upper flange; said second plurality of cantenary lines being evenly distributed about said periphery of said cylindrical wall and having an end attached thereto at a position thereon further underlying said upper flange than said end of said first plurality of catenary lines; and further including the step of raising said central core prior to said step of rotating said central core, whereby said catenary lines and said pliant reflective mesh are rolled up spirally onto said reel.

11. The method as defined in claim 9, further including the step of raising said central core prior to said step of rotating said central core, whereby said first and second plurality of catenary lines and said pliant reflective mesh are rolled up spirally onto said central core.

* * * * *